US006814599B2

(12) United States Patent
Sakiyama et al.

(10) Patent No.: US 6,814,599 B2
(45) Date of Patent: Nov. 9, 2004

(54) FASTENING STRUCTURE FOR SEALING MEMBER

(75) Inventors: Koji Sakiyama, Sakura (JP); Takehisa Ide, Sakura (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 10/668,272

(22) Filed: Sep. 24, 2003

(65) Prior Publication Data

US 2004/0063349 A1 Apr. 1, 2004

(30) Foreign Application Priority Data

Sep. 27, 2002 (JP) ..... 2002-283933

(51) Int. Cl.[7] ..... H01R 13/52
(52) U.S. Cl. ..... 439/271; 439/275
(58) Field of Search ..... 439/271, 353, 439/557, 272, 273, 274, 275

(56) References Cited

U.S. PATENT DOCUMENTS 4,842,540 A * 6/1989 Endo et al. ..... 439/271
4,869,684 A 9/1989 Cloud et al.
5,334,039 A 8/1994 Kanda
6,755,677 B2 * 6/2004 Kamiya ..... 439/381

FOREIGN PATENT DOCUMENTS

| | | |
|---|---|---|
| GB | 2 281 822 A | 3/1995 |
| JP | 9-213408 A | 8/1997 |
| JP | 10-215580 | 8/1998 |

* cited by examiner

*Primary Examiner*—Chandrika Prasad
(74) *Attorney, Agent, or Firm*—Sughrue Mion, PLLC

(57) ABSTRACT

A through hole (13) is formed on a engagement part (11) of a connector housing (14), and an installation part (32) whose distal end (32*b*) projects on an end (14*a*) of the connector housing (14) through this through hole (13) is formed on a sealing member (30). When the through hole (13) is sealed by a mold part (40) that is formed on the end (14*a*) side of the connector housing (14), the installation part (32) is also sealed, and the sealing member (30) is fastened to the connector housing (14).

13 Claims, 5 Drawing Sheets

FASTENING STRUCTURE FOR SEALING MEMBER

BACKGROUND OF THE INVENTION

1. Field of the Invention

The present invention relates to a fastening structure for a sealing member used for water proofing or the like on a connector housing, and in particular, relates to a fastening structure for a sealing member that can obtain strong water proof capacity and reliably fasten the connector housing without increasing the number of parts.

Priority is claimed to Japanese application No. 2002-283933, filed Sep. 27, 2002, which is incorporated herein by reference.

2. Description of the Related Art

A connector for performing electrical connections normally comprises a plug connector and a receptacle connector, and connection terminals made of metal are built into each of these connectors. Depending on the conditions of use, in these connectors, in particular water proofing of the connection parts of the connection terminals may be required. Generally, this type of connector is referred to as a water proof connector, and the methods for the water proofing thereof are as follows. A sealing member made of an elastomer or the like is provided on the plug connector engagement part of the receptacle connector. This sealing member is attached to the receptacle connector by a retainer or the like, the gap between the plug connector and the receptacle connector is sealed by the sealing member when the plug connector is completely engaged, and thereby the connection part of the connection terminals is water proofed. In order to perform this water proofing method, there are cases in which separate parts such as retainers for fastening the sealing member are necessary, and thus the number of parts increases, the fastening operation becomes complicated, and the costs are thereby increased.

Thus, in order to perform the water proofing method described above without increasing the number of parts, there are several structures in which a rib or the like is formed in the plug connector engagement part of the receptacle connector, and the sealing member is attached by being hooked on the rib (refer, for example, to Japanese Unexamined Patent Application, First Publication, No. Hei 9-213408).

However, in the structure in which the rib is formed on the plug connector engagement part of the receptacle connector and the sealing member is hooked on the rib, a mold removal hole is produced in the receptacle connector due to the rib mold, and therefore it is difficult to obtain strong water proof capacity.

In consideration of the problems described above, it is an object of the present invention to provide a fastening structure for a sealing member that can obtain strong water proof capacity and reliably fasten the sealing member to the connector housing.

SUMMARY OF THE INVENTION

The first fastening structure for a sealing member according to the present invention is a fastening structure for a sealing member in a connector that comprises a connector housing that forms an engagement part into which a partnering connector is inserted, connection terminals that are installed on this connector housing and are electrically connected to the partnering connectors, and a sealing member made of an elastic material and is installed on the engagement part of the connector housing and maintains a fluid-tight seal between the partnering connector and the connector housing when the partnering connector is completely inserted into the connector housing. A through hole that passes through the connector housing along the insertion direction of the partnering connector is formed in the connector housing; and the sealing member provides a sealing member main body that is installed on the connector housing and an installation part that is formed integrally with this sealing member main body and is inserted into the through hole of the connector housing so as to project its distal end part in this insertion direction from the through hole. Furthermore, on the opening end side of the through hole of the connector housing on the side opposite to the engagement part, a mold part is formed. The mold part respectively seals the proximal terminal ends of the connection terminals, the conductors that are connected to these proximal ends, and the opening part of the through hole on the side that the installation part of the sealing member is projected; and the mold part fastens the installation part of the sealing member that is projected from the through hole to the connector housing.

The second fastening structure for a sealing member according to the present invention is a fastening structure of this sealing member in a connector that comprises a connector housing that forms an engagement part into which the partnering connector is inserted, connection terminals that are installed on this connector housing and are electrically connected to the partnering connector, and a sealing member made of an elastic material that is installed in the engagement part of the connector housing and maintains a fluid-tight seal between the partnering connector and the connector housing when the partnering connector is completely inserted into the connector housing. A through hole that passes through the connector housing along the insertion direction of the partnering connector is formed in the connector housing, and a projection that is formed at a position on an inner wall of the connector housing in a direction perpendicular to the insertion direction towards the part corresponding to the position of the through hole so as to project in this perpendicular direction. The sealing member comprises a sealing member main body that is installed on the connector housing, and the projection is formed at a position that does not overlap the installation position of the sealing member main body in the connector housing. Furthermore, on the opening end side of the through hole of the connector housing on the side opposite to the engagement part, a mold part is formed. The mold part respectively seals the proximal terminal ends of the connection terminals, the conductors that are connected to these proximal ends, and the through hole; and the sealing member is fastened to the connector housing due to the projection and the mold part that seals the through hole and extends to the sealing member main body.

According to the present invention, because the installation part of the sealing member projects on the side opposite to the engagement part through the through hole formed in the connector housing and the mold part is formed in the connector housing so as to seal the through hole by enclosing the installation part, a retainer or the like for fastening the sealing member becomes unnecessary, and the sealing member can be reliably fastened to the connector housing. Furthermore, because the through hole in the connector housing is sealed by the mold part, strong water proofing can be obtained.

In addition, according to the present invention, because the sealing member main body of the sealing member is hooked on the projection formed in the engagement part of the connector housing and is fastened to the connector housing by a mold part that seals the through hole, the sealing member is reliably fastened to the connector housing while maintaining a strong water proofing.

Moreover, in the first fastening structure of the sealing member of the present invention, preferably the through hole of the connector housing is completely sealed by the mold part along with the installation part of the sealing member.

In addition, the sealing member preferably is formed on the distal end part of the installation part along the insertion direction and has a stopper part that engages the opening edge of the through hole. When the stopper part is engaged, the sealing member can be even more reliably fastened to the connector housing.

Moreover, in the fastening structure for the sealing member of the present invention, preferably a protector part composed of a plurality of grooves which are formed along the direction perpendicular to a longitudinal direction of the conductors is provided on an end part of the mold part along the longitudinal direction of the conductors. Thereby, it is possible to effectively prevent cutting of the conductors in the end of the mold part.

DETAILED DESCRIPTION OF PREFERRED EMBODIMENTS

Below, the preferred embodiments of the present invention are explained with reference to the attached drawings.

Figure 1:
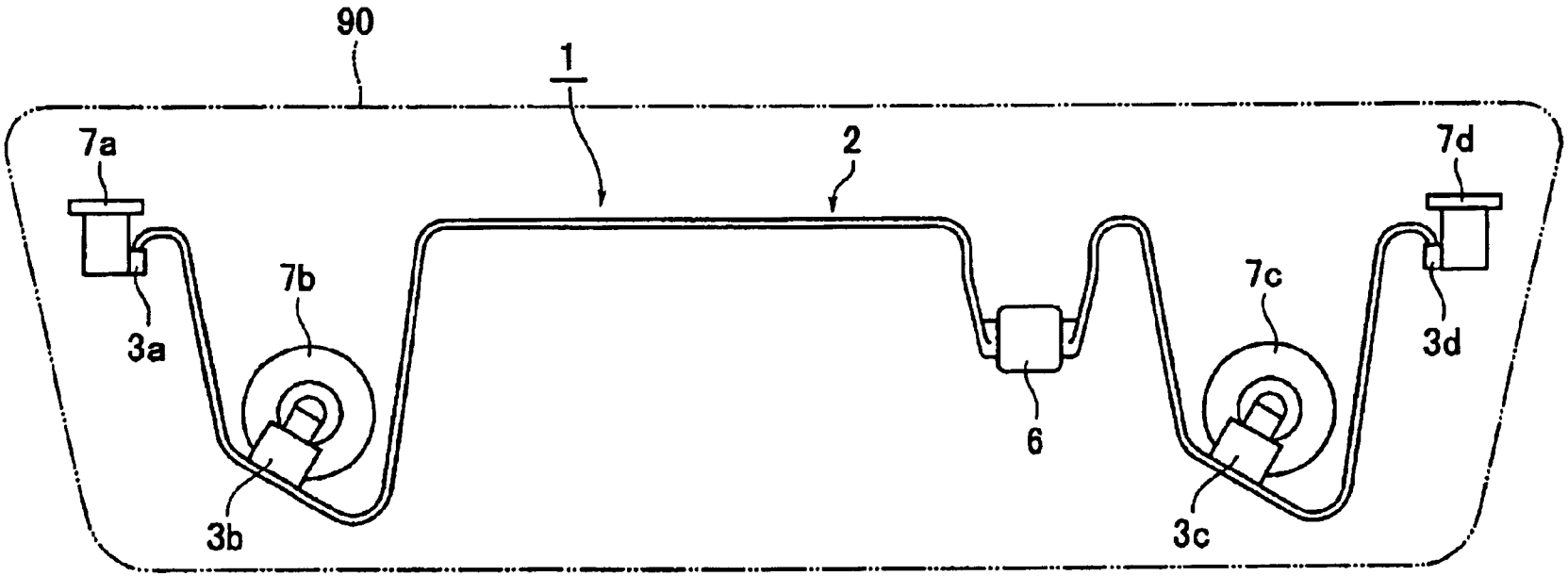
FIG. 1 is a simplified layout drawing showing the flat harness providing a connector that implements the fastening structure for the sealing member according to an embodiment of the present invention.
Figure 2:
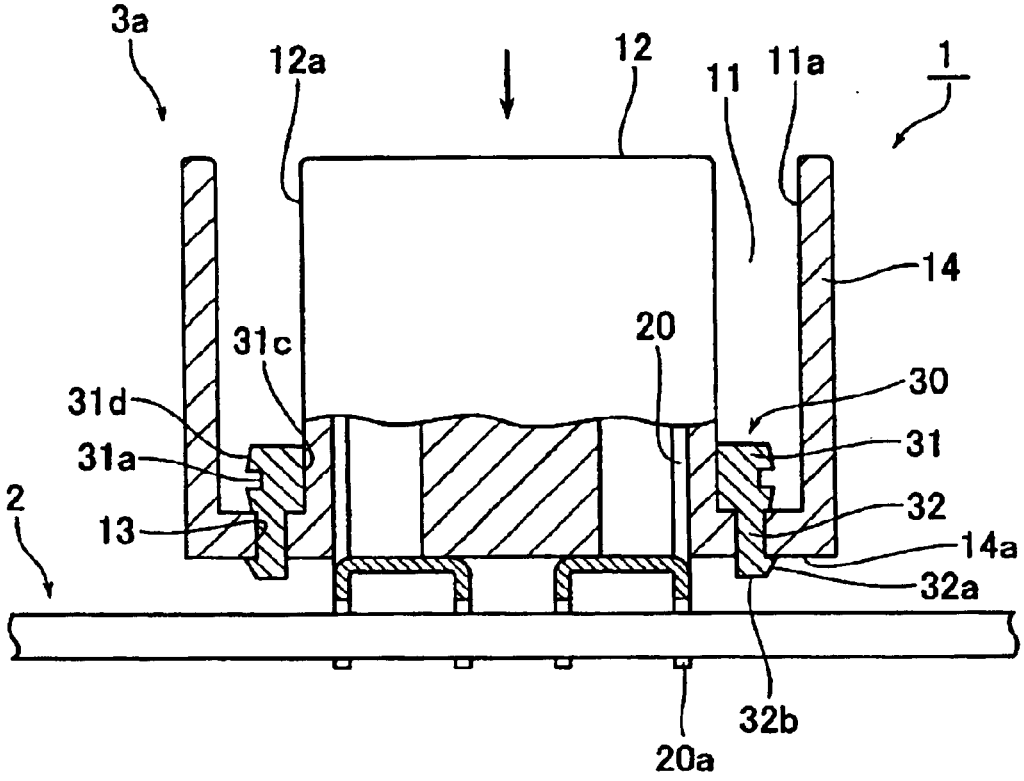
FIG. 2 is a partial cross-sectional drawing where the mold part is removed from the connector installation part of the flat harness.
Figure 3:
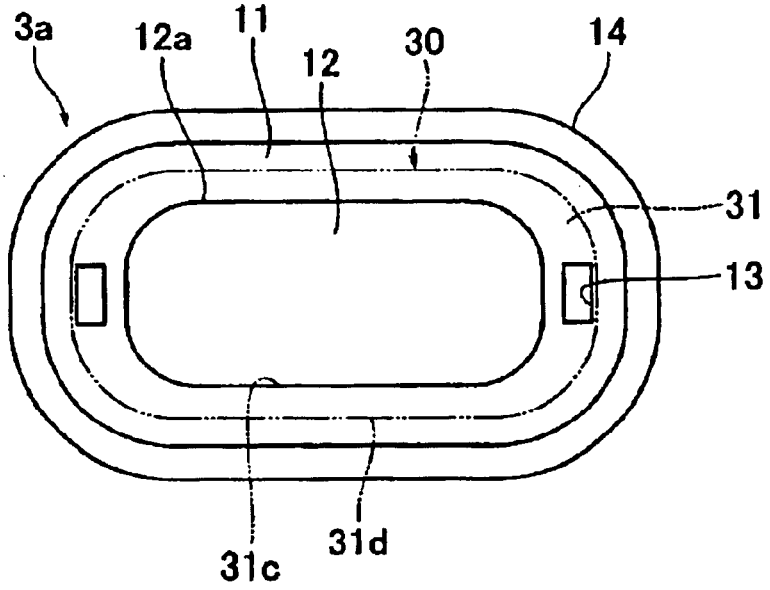
FIG. 3 is an upper view of the flat harness of FIG. 2.
Figure 4:
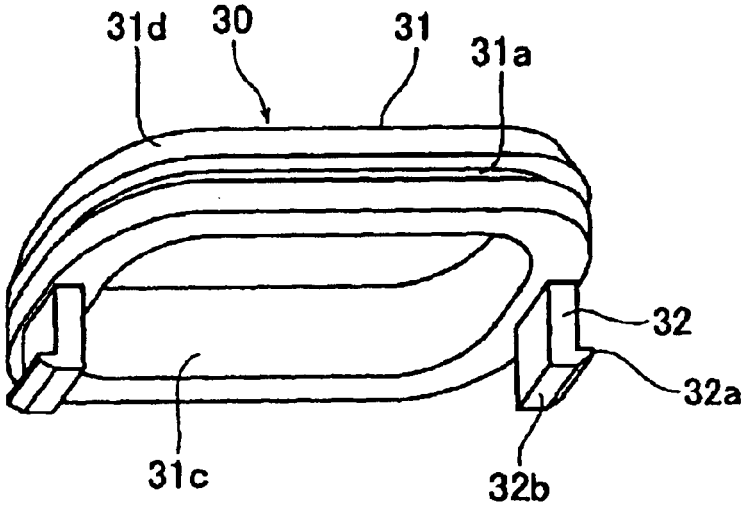
FIG. 4 is a perspective drawing showing the sealing member fastened to the connector.
Figure 5:
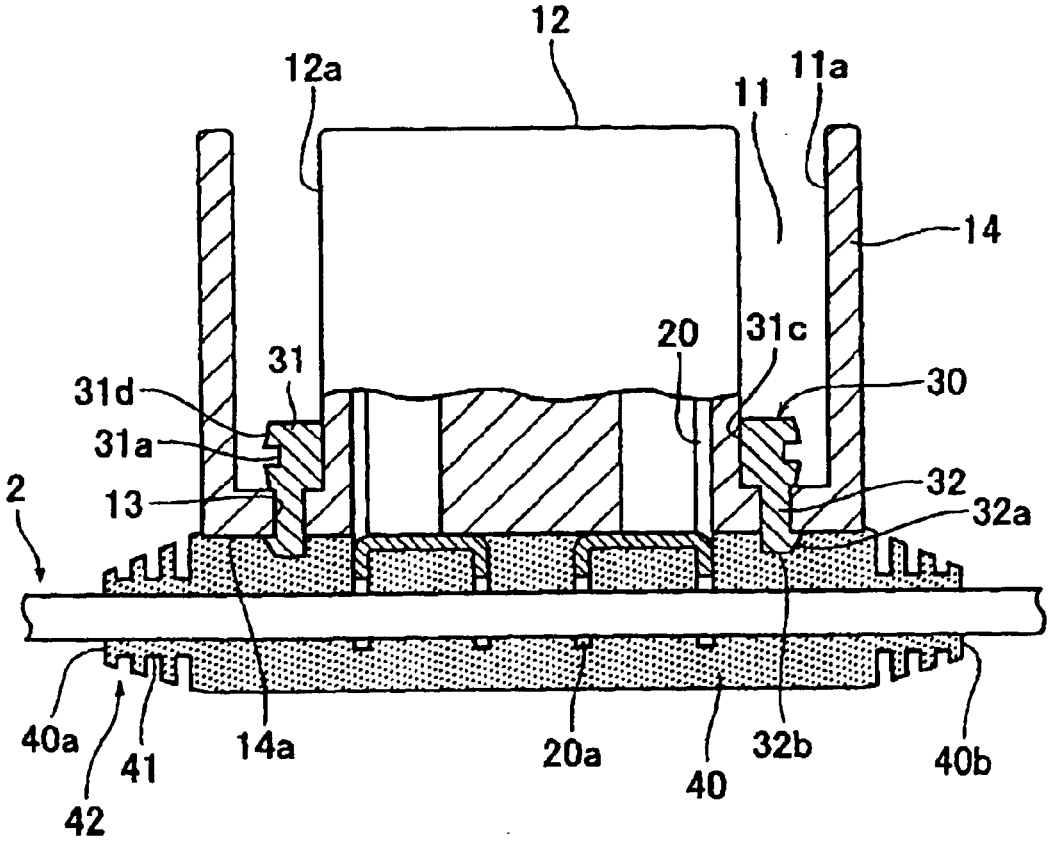
FIG. 5 is a partial cross-sectional drawing of the connector installation part of the flat harness.

FIG. 1 is a simplified layout drawing showing the flat harness providing a connector that implements the fastening structure for the sealing member according to an embodiment of the present invention; FIG. 2 is a partial cross-sectional drawing where the mold part is removed from the connector installation part of this flat harness; FIG. 3 is an upper view of this flat harness; FIG. 4 is a perspective drawing showing the sealing member; and FIG. 5 is a partial cross-sectional drawing of the connector installation part of this flat harness.

As shown in FIG. 1, the flat harness 1 comprises a flat cable 2 comprising a plurality of conductors that are covered by an insulating covering and arrayed in a flat configuration, a plurality of connectors 3*a*, 3*b*, 3*c*, and 3*d* that are installed on this flat cable 2, and a relay connector 6 installed between the ends of the flat cable 2. Each of the auxiliary devices 7*a*, 7*b*, 7*c*, and 7*d* that provide connector connection parts that engage the connectors 3*a* to 3*d* are installed on the installed module 90, and each of the auxiliary devices 7*a* to 7*d* are electrically connected. Moreover, connection terminals (not illustrated; described below) which are connected to the auxiliary devices 7*a* to 7*d* are installed on connectors 3*a* to 3*d*, and relay connection terminals (not illustrated) which are connected to other harnesses are installed on the relay connector 6. In addition, a mold part (not illustrated; described below) is formed on the connection terminals of the connectors 3*a* to 3*d* and the relay connector 6, and the connection part between the relay connection terminals and the conductors of the flat cable 2.

As shown in FIG. 2, the connectors 3*a* to 3*d* (in this example, the receptacle connector; below, explained using connector 3*a* as an example) are resin molded units providing a concaved engagement part 11 in which the plug connector (not illustrated) that serves as the connector connection part of each of the auxiliary devices 7*a* to 7*d*; a connection terminal accommodation part 12 that accommodates the connection terminals 20; and through holes 13 that pass from the engagement part 11 in the engagement direction of the plug connector (the direction of the arrow in the figure). Moreover, the connection terminals 20 are, for example, fork terminals, and the conductors (not illustrated) of the flat cable 2 are connected by being crimped to the crimping part 20*a*.

A sealing member 30 is fastened to the connector housing 14 of this connector 3*a*. The sealing member 30 is made of an elastic material such as an elastomer, and the inner circumference 31*a* provides a ring-shaped sealing member main body 31 that engages the outer wall 12*a* of the connection terminal accommodation part 12 and an installation part 32 whose distal end 32*b* projects towards the end 14*a* of the connector housing 14 on a side opposite to the side in which the engagement part 11 is formed, through the though hole 13. A groove 31*a* (refer to FIG. 4) is formed on the outer circumference 31*d* of the sealing member main body 31, and a stopper part 32*a* (refer to FIG. 4) is formed on the distal end along the insertion direction of the installation part 32. The groove 31*a* is provided in order to absorb the deformations of the sealing member main body 31 during the engagement of the plug connector into the engagement part 11 and to increase the quality of the seal with the plug connector. Moreover, the installation part 32 can also be what is termed a straight form, where the stopper part 32*a* is not formed. In addition, as show in FIG. 3, the inner circumference 31*c* of the sealing member main body 31 of the sealing member 30 is engaged to the outer wall 12*a* of the connection terminal accommodation part 12 without leaving a gap, and thus the water proofing characteristics therebetween are maintained.

In contrast, the distal end 32*b* of the installation part 32 of the sealing member 30 projects towards the end 14*a* side of the connector housing 14 through the through hole 13, and as a result, the stopper part 32*a* is engaged with an opening edge of the through hole 13. However, the installation part 32 does not always have a form that engages the through hole 13 so as to cover it without leaving a gap, and thus, there are cases where a gap remains therebetween. Therefore, on the end 14*a* side of the connector housing 14, a mold part 40 as shown in FIG. 5 is formed, and the connection part between the connection terminals 20 and the flat cable 2 and the opening part of the through hole 13 on at least the side where the distal end 32*b* of the installation part 32 is projected are sealed. Due to this mold part 40, the distal end 32*b* of the installation part 32 and the stopper part 32*a* are sealed and fastened to the connector housing 14. Thereby, the sealing member 30 is fastened to the connector housing 14. Moreover, as shown in FIG. 6, in the case that the installation part 32 of the sealing member 30 is a straight form that does not have a stopper part as well, similarly the sealing member 30 is sealed and fastened to the connector housing 14 by the mold part 40.

In this manner, according to this fastening structure for the sealing member, the sealing member 30 is fastened by sealing the installation part 32 of the sealing member 30 to the connector housing 14 by the mold part 40 that seals the connection part between the connection terminals 20 and the flat cable 2. Thereby, a strong water proofing can be obtained, and the sealing member 30 can be reliably fastened to the connector housing 14. In addition, the engagement part of the plug connector is engaged between the inner wall 11*a* of the engagement part 11 of the connector housing 14 and the outer periphery 31*d* of the sealing member main body 31 of the sealing member 30. Thereby, the connection part between the plug connector and the connector 3*a* is sealed at the engagement part 11 by the sealing member 30.

Figure 6:
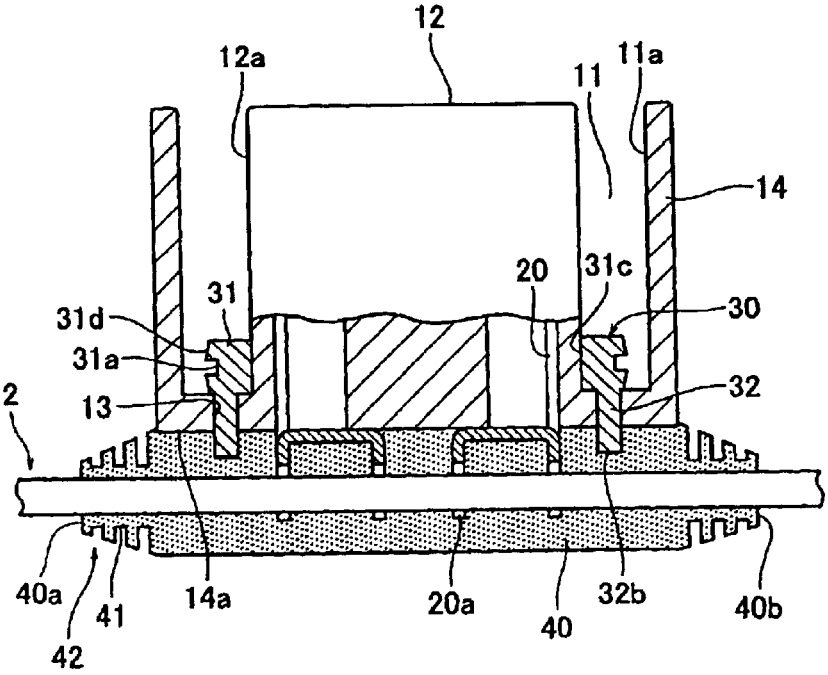
FIG. 6 is a partial cross-sectional drawing of the connector installation part of the flat harness.

Moreover, as shown in FIG. 5 and FIG. 6, a protector 42 is formed on the end adjacent to the ends 40*a* and 40*b* along the longitudinal direction of the flat cable 2 of the mold 40. This protector 42 comprises a plurality of grooves 41 formed along the direction perpendicular to this longitudinal direction. The bending this protector 42 makes it possible to prevent, for example, severing of the conductors of the flat cable 2.

Figure 7:
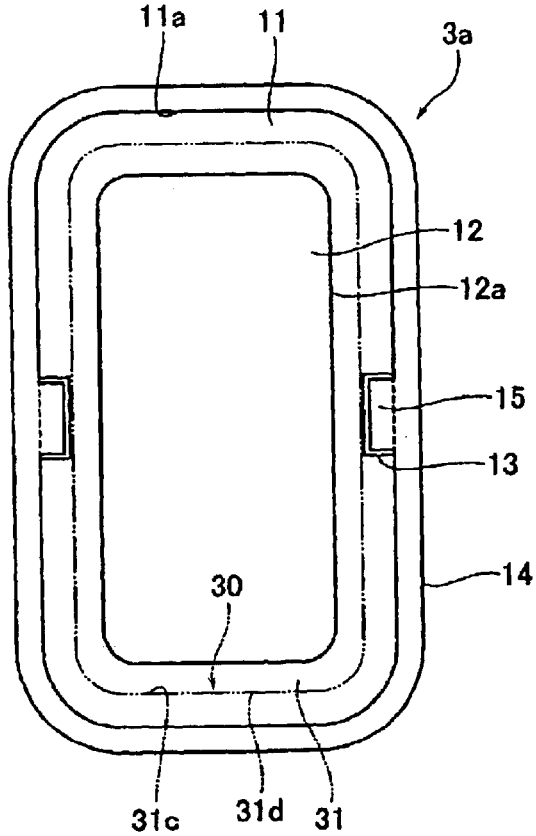
FIG. 7 is an upper view showing the connector that implements the fastening structure for the sealing member according to another embodiment of the present invention.
Figure 8:
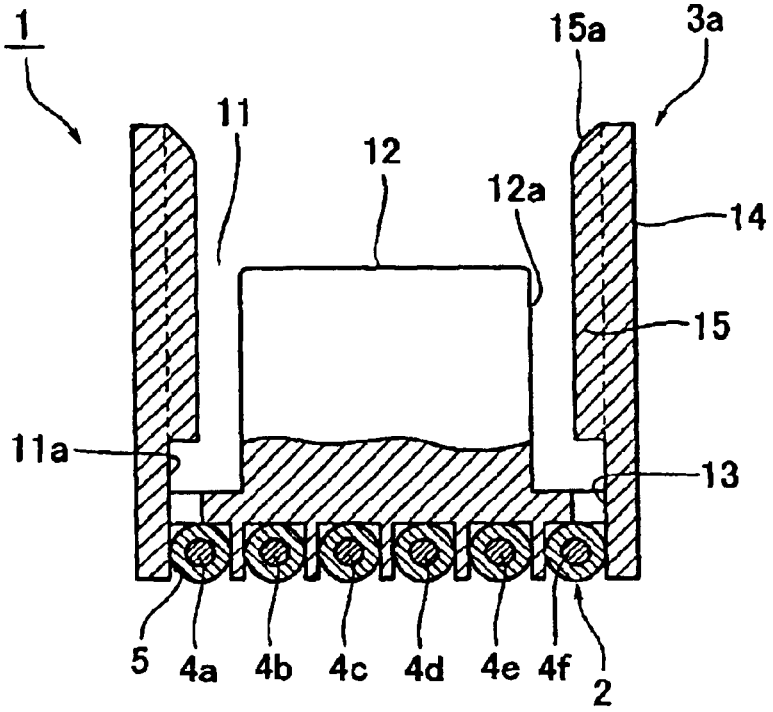
FIG. 8 is a partial cross-sectional drawing of the flat harness when the sealing member and the mold part are removed from the connector.
Figure 9:
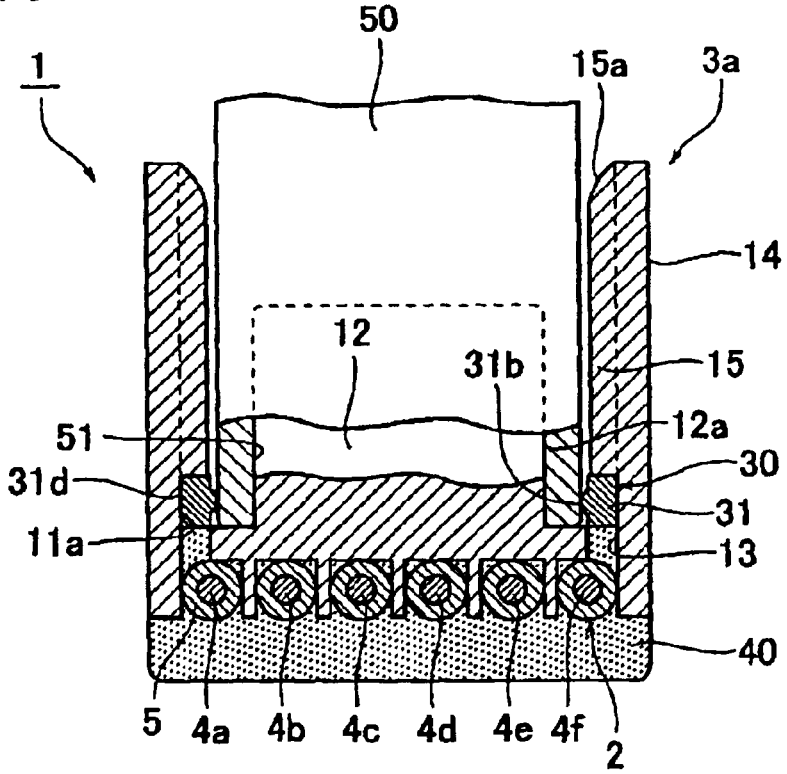
FIG. 9 is a partial cross-sectional drawing of the connector installation part of the flat harness.

FIG. 7 is an upper view showing the connector that implements the fastening structure for the sealing member according to another embodiment of the present invention; FIG. 8 is a partial cross-sectional drawing of the flat harness where the sealing member and the mold part have been removed from this connector; and FIG. 9 is a partial cross-sectional drawing of the connector installation part of this flat harness. Moreover, in the following descriptions, explanations that repeat those of parts already explained are omitted.

As shown in FIG. 7 to FIG. 9, a rib 15 that serves as a projection that projects in the direction perpendicular to the engagement direction of the plug connector is formed on the inner wall 11*a* of the engagement part 11 of the connector housing 14 of the connector 3*a*. Furthermore, a through hole 13 is formed at a position corresponding to this rib 15 at the farthest forward position in the engagement direction of the plug connector to the connector housing 14. This through hole 13 is formed while extracting a mold form having a contour corresponding to the rib 15 when the connector housing 14 is molded. Moreover, an edge portion 15*a* of an opening end side of engagement part 11 of the rib 15 is formed in the shape of a slope, without steps. Thereby, the engagement of the sealing member 30 into the engagement part 11 can be carried out easily. The sealing member 30 has a sealing member main body 31, and the outer circumference 31*d* thereof has a shape that engages in the inner wall 11*a* of the engagement part 11 without a gap remaining. In addition, a projecting portion 31*b* is formed on the inner circumference 32*a* thereof. This projecting portion 31*b* is provided in order to improve the sealing characteristics between the plug connector and the sealing member 30. As shown in FIG. 9, the sealing member main body 31 of the sealing member 30 is installed between the rib 15 and the through hole 13 at the engagement part 11, and positioned at the position where the inner circumference 31*d* tightly contacts the inner wall 11*a* of the engagement part 11. In addition, the connection part between the connection terminals (not illustrated) and the flat cable 2, and the though hole 13 are sealed by the mold part 40. Thereby, the sealing member 30 is fastened to the connector housing 14 by hooking the rib 15, and also fastened by the mold part 40 that reaches the sealing member main body 31 through the through hole 13. In addition, the engagement part 51 of the plug connector 50 is engaged between the outer wall 12*a* of the connection terminal accommodation part 12 of the connector housing 14 and the projecting portion 31*b* formed on the inner circumference 31*c* of the sealing member main body 31 of the sealing member 30. Thereby, the connection part between the plug connector 50 and the connector 3*a* is sealed by the sealing member 30.

In this manner, according to the fastening structure for this sealing member, the sealing member main body 31 is fastened to the connector housing 14 of the sealing member 30 by sealing the through hole 13 by the mold part 40 that seals the connection part between the connection terminals 20 and the flat cable 2. Furthermore, the sealing member main body 31 of the sealing member 30 is also fastened by the rib 15 formed on the engagement part 11 of the connector housing 14. Thereby, the sealing member 30 is further reliably fastened to the connector housing 14. In addition, because the through hole 13 is completely sealed by the mold part 40, a strong water proofing can be maintained.

Moreover, as shown in FIG. 8 and FIG. 9, the flat cable 2 that forms this flat harness 1 has a flat cable structure wherein covering conductors 4*a*, 4*b*, 4*c*, 4*d*, 4*e* and 4*f* which comprising a wire such as a single wire or stranded wire made of a rod-shaped conductor which is made of Cu or Al for example, are covered by an insulating covering 5 which comprising an insulating resin such as polyethylene terephthalate (PET), polyethylene naphthalate (PEN), polyolefin (PO), or the like, and each of the insulating coverings 5 is joined to each other by a bridge part (not illustrated) made of an insulating resin identical to that of the insulating covering 5. The flat cable 2 can also be a flexible flat cable having a structure wherein a rectangular column shaped conductor 4 is covered by an insulating covering 5 formed so as to be flat by a laminator or extrusion.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as limited by the foregoing description but is only limited by the scope of the appended claims.

What is claimed is:

1. A fastening structure for sealing member comprising:

a connector housing that forms an engagement part into which a partnering connector is inserted;

connection terminals installed in this connector housing and electrically connected to said partnering connector; and a sealing member made of an elastic material and is installed on the engagement part of said connector housing and that maintains a fluid-tight seal between said partnering connector and said connector housing when said partnering connector is completely inserted into said connector housing; wherein a though hole that passes through said connector housing along an insertion direction of said partnering connector is formed in said connector housing;

said sealing member comprises a sealing member main body that is installed o said connector housing, and an installation part that is formed integrally with this sealing member main body and is inserted into said through hole of said connector housing so as to project its distal end part in this insertion direction from said through hole; and a mold part that seals proximal terminal ends of said connection terminals, conductors that are connected to these proximal ends, and an opening part of said through hole on the side that said installation part is projected, is formed on the opening end side of the through hole of the connector housing on the side opposite to the engagement part; and said mold part fastens said installation part of said sealing member that is projected from said through hole to said connector housing.

2. A fastening structure for sealing member according to claim 1 wherein said though hole of said connector housing is completely sealed along with said installation part of said sealing member by said mold part.

3. A fastening structure for sealing member according to claim 1 or claim 2 wherein said sealing member is formed on the distal end part along the insertion direction of said installation part, and has a stopper part that engages an opening edge of said through hole.

4. A fastening structure for sealing member according to any one of claims 1 through 3 wherein a projection is formed in the inner wall in a direction perpendicular to said engagement direction of the engagement part of said connector housing at a position that does not overlap the installation position of the scaling member main body of said scaling member and projects in said perpendicular direction at a position corresponding to that of said through hole in said engagement direction.

5. A fastening structure for sealing member according to any one of claims 1 through 4 wherein a protector part composed of a plurality of grooves which are formed along a direction perpendicular to a longitudinal direction of said conductors is provided on an end part of said mold part along the longitudinal direction of said conductors.

6. A fastening structure for sealing member according to claim 2 wherein said sealing member is formed on the distal end part along the insertion direction of said installation part, and has a stopper part that engages an opening edge of said through hole.

7. A fastening structure for sealing member according to claim 2 wherein a projection is formed in the inner wall in a direction perpendicular to said engagement direction of the engagement part of said connector housing at a position that does not overlap the installation position of the sealing member main body of said sealing member and projects said perpendicular direction at a position corresponding to that of said through hole in said engagement direction.

8. A fastening structure for scaling member according to claim 3 wherein a projection is fanned in the inner wall in a direction perpendicular to said engagement direction of the engagement pert of said connector housing at a position that does not overlap the installation position of the scaling member main body of said scaling member and projects in said perpendicular direction at a position corresponding to that of said through hole in said engagement direction.

9. A fastening structure for sealing member according to claim 2 wherein a protector part composed of a plurality of grooves which are formed along a direction perpendicular to a longitudinal direction of said conductors is provided on an end part of said mold part along the longitudinal direction of said conductors.

10. A fastening structure for sealing member according to claim 3 wherein a protector part composed of a plurality of grooves which arc formed along a direction perpendicular to a longitudinal direction of said conductors is provided on an end part of said mold part along the longitudinal direction of said conductors.

11. A fastening structure for sealing member according to claim 4 wherein a protector part composed of a plurality of grooves which are formed along a direction perpendicular to a longitudinal direction of said conductors is provided on an end part of said mold part along the longitudinal direction of said conductors.

12. A fastening structure for sealing member comprising:

a connector housing that foams an engagement part into which a partnering connector inserted;

connection terminals that are installed on this connector housing and are electrically connected to said partnering connector, and a sealing member made of an elastic material that is installed in said engagement part of said connector housing and maintains a fluid-tight seal between said partnering connector and said connector housing when said partnering connector is completely inserted into said connector housing, wherein a through hole that passes through said connector housing along an insertion direction of said partnering connector is foamed in said connector housing, and a projection that is formed a position on an inner wall of said connector housing an a direction perpendicular to the insertion direction towards a part corresponding to a position of said through hole so as to project in this perpendicular direction;

said sealing member comprises a sealing member main body that is installed on said connector housing, and said projection is formed at a position that does not overlap an installation position of said sealing member main body in said connector housing;

a mold part that respectively seals a proximal terminal ends of maid connection terminals, said conductors which are connected to these proximal ends, and said through hale, is form on an opening end side of said through hole of said connector housing on a side opposite to said engagement part; and said sealing member is fastened to said connector housing due to said projection and said mold part that seals said through hole and extends to said sealing member main body.

13. A fastening structure for sealing member according to claim 12 wherein a protector part composed of a plurality of grooves which are formed along a direction perpendicular to a longitudinal direction of said conductors is provided on an end part of said mold part along the longitudinal direction of said conductors.

* * * * *